US008147116B1

(12) United States Patent
Hsiao

(10) Patent No.: US 8,147,116 B1
(45) Date of Patent: Apr. 3, 2012

(54) SAFETY LAMP BULB CONNECTOR ASSEMBLY

(76) Inventor: Ming Jen Hsiao, Toufen (TW)

( * ) Notice: Subject to any disclaimer, the term of this patent is extended or adjusted under 35 U.S.C. 154(b) by 0 days.

(21) Appl. No.: 13/094,975

(22) Filed: Apr. 27, 2011

Related U.S. Application Data

(63) Continuation-in-part of application No. 12/981,920, filed on Dec. 30, 2010.

(51) Int. Cl.
*H01R 33/00* (2006.01)

(52) U.S. Cl. ..... 362/640; 362/641; 362/326

(58) Field of Classification Search ..... 362/640, 362/641, 285, 287; 439/11
See application file for complete search history.

(56) References Cited

U.S. PATENT DOCUMENTS 1,990,729 A * 2/1935 Elwell ..... 362/437
4,141,062 A * 2/1979 Trueblood ..... 362/400
4,509,105 A * 4/1985 Short, Sr. ..... 362/122
6,981,783 B2 * 1/2006 Kao ..... 362/285
7,938,564 B2 * 5/2011 Kwong et al. ..... 362/329

* cited by examiner

*Primary Examiner* — Ali Alavi
(74) *Attorney, Agent, or Firm* — Chun-Ming Shih

(57) ABSTRACT

A safety lamp bulb connector assembly includes a lamp socket with a bottom flange, retaining blocks located on the periphery of the lamp socket and spaced above the bottom flange of the lamp socket, a screw holder disposed adjacent to the bottom flange of the lamp socket, a lampshade having a center opening cut through the bottom wall thereof for receiving the lamp socket and two notches radially outwardly extended from the center opening at two opposite sides for the passing of the retaining blocks for enabling the lampshade to be secured to the lamp socket after insertion of the retaining blocks through the notches and rotation of the lampshade through an angle relative to the lamp socket, and a screw mounted in the screw holder and inserted into one notch of the lampshell to prohibit rotation of the lampshade relative to the lamp socket.

9 Claims, 5 Drawing Sheets

SAFETY LAMP BULB CONNECTOR ASSEMBLY

RELATED APPLICATIONS

This application is a continuation-in-part of U.S. patent application Ser. No. 12/981,920, filed on Dec. 30, 2010.

BACKGROUND OF THE INVENTION

1. Field of the Invention

The present invention relates to lighting fixtures and more particularly, to a safety lamp bulb connector assembly, which safety lamp bulb connector assembly, which prohibits a child from moving the lampshade from the lamp socket to touch the internal metal electric components accidentally, assuring a high level of safety.

2. Description of the Related Art

U.S. Pat. No. 6,921,180B2 discloses a lighting fixture entitled "Connector of a C-type bulb assembly". which includes two half symmetric pieces, wherein the first piece having its two side projections provided with related rods and the second piece having its two side projections provided with related apertures. The two half pieces can be assembled together to become the connector while the bulb holder is connected therein, and the holder with the connector is capable of being assembled or disassembled with the shell easily and quickly. As the holder with the connector can be assembled or disassembled with the shell easily and quickly without tool, a child may separate the holder with the connector from the shell and touch the internal metal conducting members, causing an electric shock accident.

SUMMARY OF THE INVENTION

The present invention has been accomplished under the circumstances in view. It is one object of the present invention to provide a safety lamp bulb connector assembly, which prohibits a child from moving the lampshade from the lamp socket to touch the internal metal electric components accidentally, assuring a high level of safety.

To achieve this and other objects of the present invention, a safety lamp bulb connector assembly includes an electric connector assembly and a lampshade. The electric connector assembly includes a lamp socket disposed at a top side thereof and having a bottom flange, at least one retaining block located on the periphery of the lamp socket and spaced above the bottom flange, and a screw holder disposed adjacent to the bottom flange of the lamp socket. The lampshade is mountable on the lamp socket, comprising a bottom wall, a center opening cut through the bottom wall for receiving the lamp socket, and at least one notch cut through the bottom wall and radially outwardly extended from the center opening for the passing of the at least one retaining block. The center opening has a diameter greater than the diameter of the periphery of the lamp socket and smaller than the diameter of the bottom flange of the lamp socket. The screw is mounted in the screw hole and inserted into one notch of the lampshell to prohibit rotation of the lampshade relative to the lamp socket.

Because the lampshade is locked to the electric connector assembly by the retaining blocks and the screw after installation, a child cannot directly remove the lampshade from the lamp socket, avoiding touching the metal electric conducting members of the safety lamp bulb connector assembly accidentally. Therefore, the invention meets electrical engineering codes and electrical safety specifications.

Further, preferably, the lampshade comprises two notches cut through the bottom wall and radially outwardly extended from the center opening in reversed directions; the electric connector assembly comprises two retaining blocks located on the periphery of the lamp socket at two opposite sides corresponding to the two notches.

Further, the two notches have different sizes.

The electric connector assembly further comprises symmetric first shell and second shell fastened together to hold the bottom flange of the lamp socket therein and to keep the at least one retaining block on the outside of the first shell and the second shell.

Further, the first shell and the second shell each comprise a threaded arched block. The threaded arched block of the first shell is abutted against the threaded arched block of the second shell to form the screw holder.

Further, the screw holder can be located on the periphery of the bottom flange of the lamp socket.

The safety lamp bulb connector assembly further comprises a rubber ring sleeved onto the lamp socket between the bottom flange and the at least one retaining block to enhance connection stability between the lampshade and the lamp socket.

Further, the lamp socket holds an electric lamp bulb.

DETAILED DESCRIPTION OF THE PREFERRED EMBODIMENT

Figure 1:
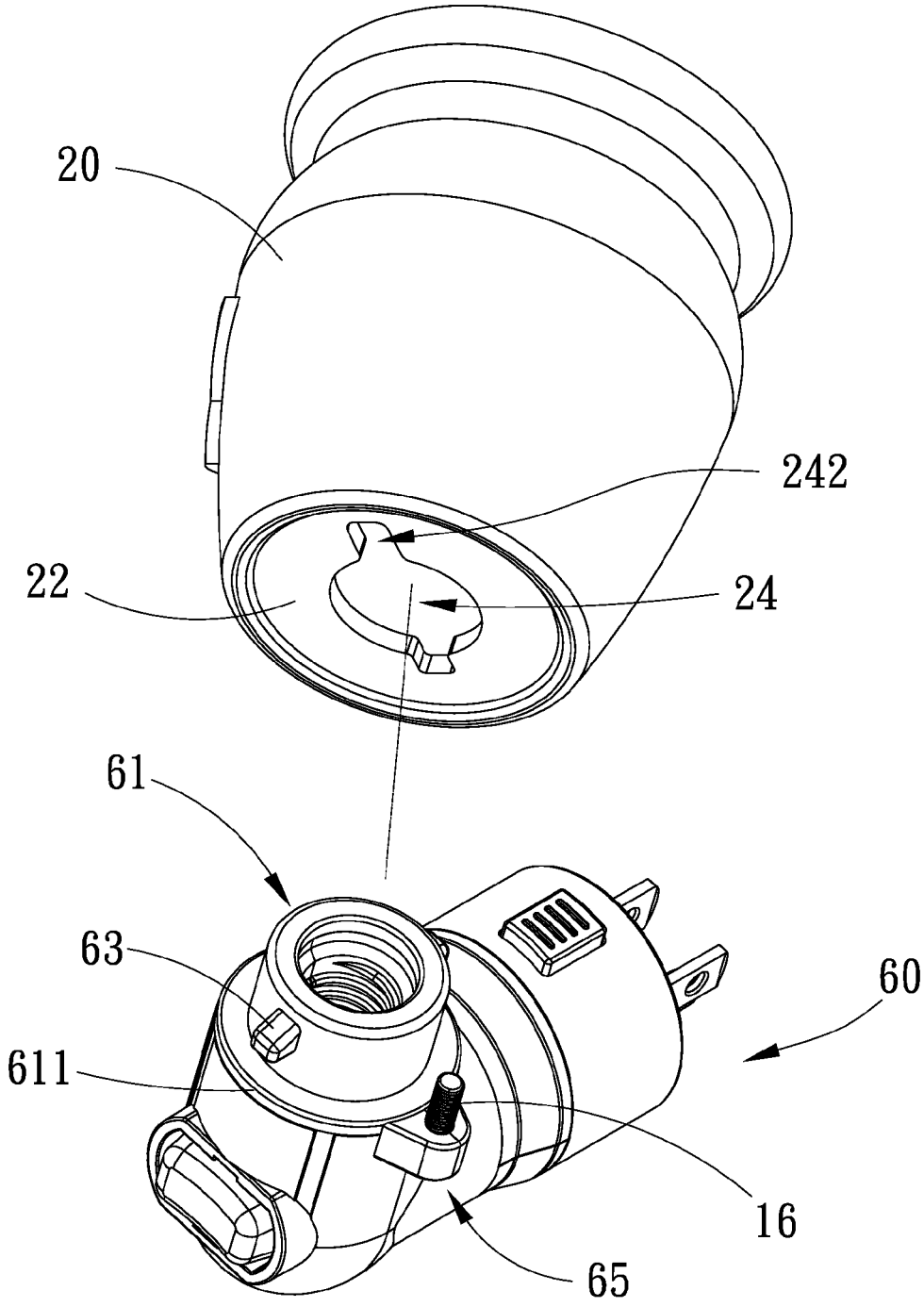
FIG. 1 is an exploded view of a safety lamp bulb connector assembly in accordance with a first embodiment of the present invention.

Referring to FIG. 1, a safety lamp bulb connector assembly in accordance with a first embodiment of the present invention is shown comprising an electric connector assembly 60 and a lampshade 20. The electric connector assembly 60 includes a lamp socket 61, at least one, for example, two retaining blocks 63, and a screw holder 65. The lamp socket 61 is disposed at the top side of the electric connector assembly 60, having a bottom flange 611 extending around the periphery of the bottom side thereof. The two retaining blocks 63 are symmetrically protruded from the periphery of the lamp socket 61 at two opposite sides. The screw holder 65 is protruded from the periphery of a part of the electric connector assembly 60 adjacent to the bottom flange 611 of the lamp socket 61. The lampshade 20 comprises a bottom wall 22, a center opening 24 cut through the bottom wall 22, and at least one, for example, two notches 242 cut through the bottom wall 22 and radially extended from the center opening 24 in reversed directions.

The lamp socket 61 holds a lamp bulb (not shown). During installation, aim the retaining blocks 63 at the respective notches 242 of the lampshade 20, and then insert the lamp socket 61 of the electric connector assembly 60 with the loaded lamp bulb through the center opening 24 into the inside of the lampshade 20 to let the bottom flange 611 of the lamp socket 61 be stopped against the outer surface of the bottom wall 22, and then rotate the lampshade 20 relative to the electric connector assembly 60 through a certain angle, for example, 90° angle to keep the screw holder 65 in alignment with one notch 242 of the lampshade 20, and then use a tool to drive a screw 16 through the screw holder 65 into the respective notch 242, prohibiting rotation of the lampshade 20 relative to the lamp socket 61. Thus, the lampshade 20 is firmly secured to the electric connector assembly 60. This installation procedure is quite simple without making any further screw hole on the lampshade 20 for receiving the screw 16.

Figure 2:
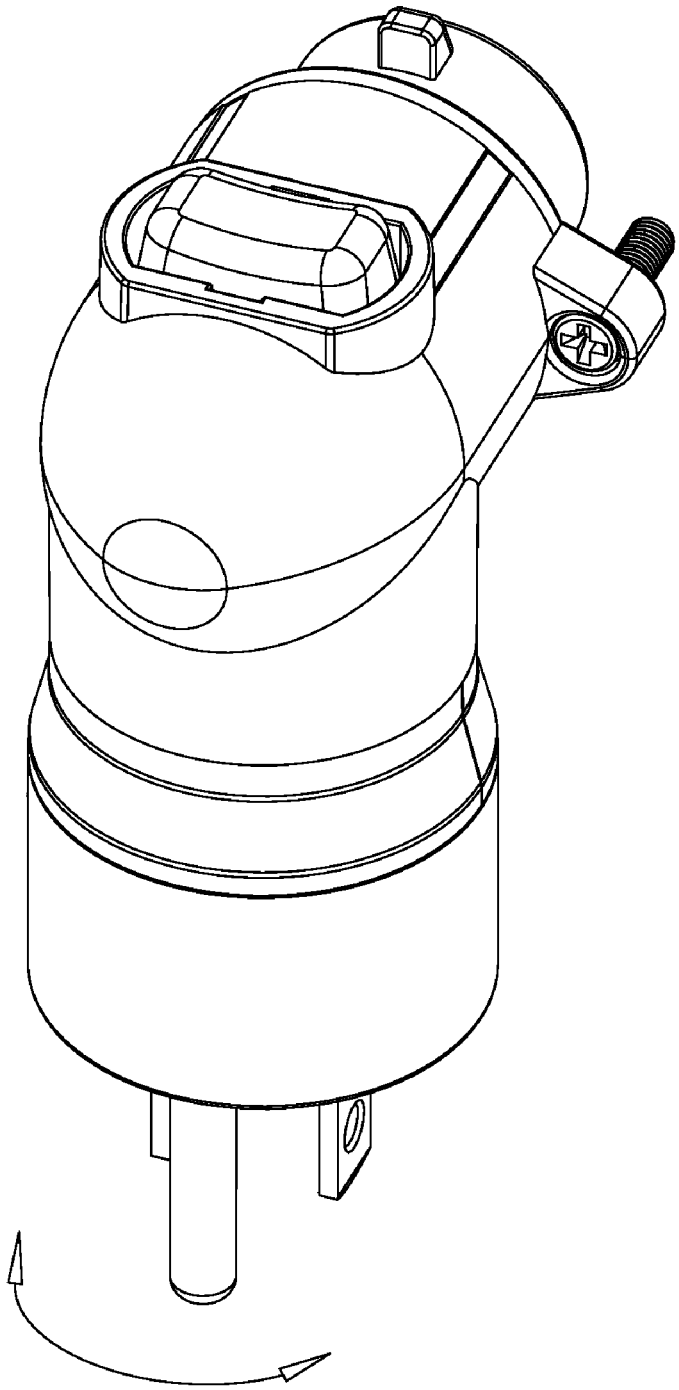
FIG. 2 is an elevational assembly view of the safety lamp bulb connector assembly in accordance with the first embodiment of the present invention.

Referring to FIG. 2 and FIG. 1 again, when going to replace the lamp bulb, use a hand tool, for example, screwdriver to remove the screw 16 from the bottom wall 22 of the lampshade 20 and the screw holder 65, and then rotate the lampshade 20 relative to the lamp socket 61 to shift the notches 242 into alignment with the respective retaining blocks 63, and then separate the lampshade 20 from the lamp socket 61 of the electric connector assembly 60. Because the lampshade 20 is locked to the electric connector assembly 60 by the retaining blocks 63 and the screw 16, a child cannot directly remove the lampshade 20 from the lamp socket 61, avoiding touching the metal electric conducting members of the safety lamp bulb connector assembly accidentally. Therefore, the invention meets electrical engineering codes and electrical safety specifications.

Figure 3:
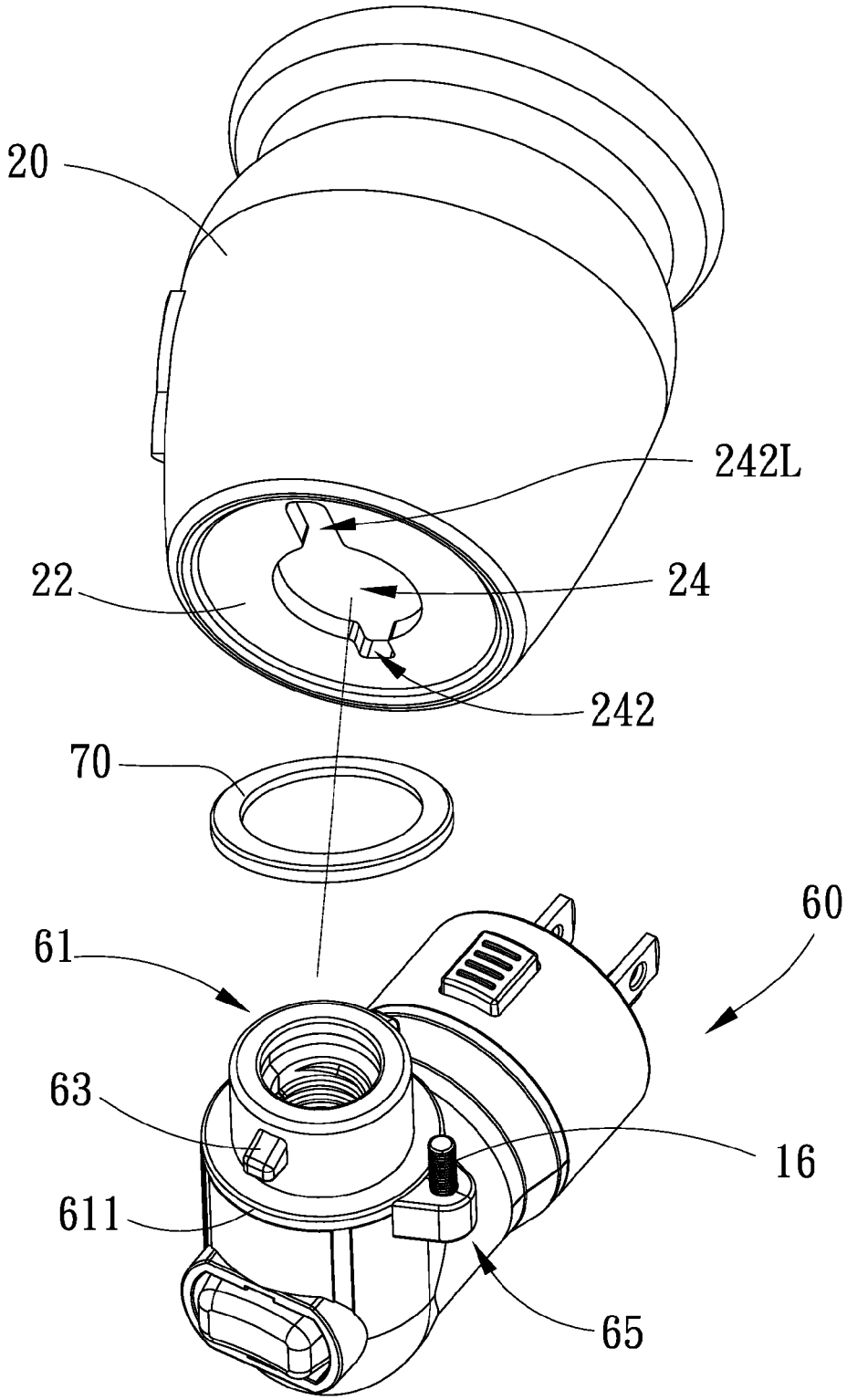
FIG. 3 corresponds to FIG. 1, illustrating a rubber ring used.

Referring to FIG. 3, in the preferred embodiment of the present invention, the two symmetric notches 242 of the lampshade 20 match the two symmetric retaining blocks 63 of the electric connector assembly 60, enhancing connection stability.

Further, the two notches 242 have different sizes to fit different lighting fixtures/night lamps and the distance between the screw 16 at the screw holder 65 and the periphery of the bottom flange 611 of the lamp socket 61. The notch, referenced by 242L, is relatively greater than the other notch, referenced by 242.

Figure 4:
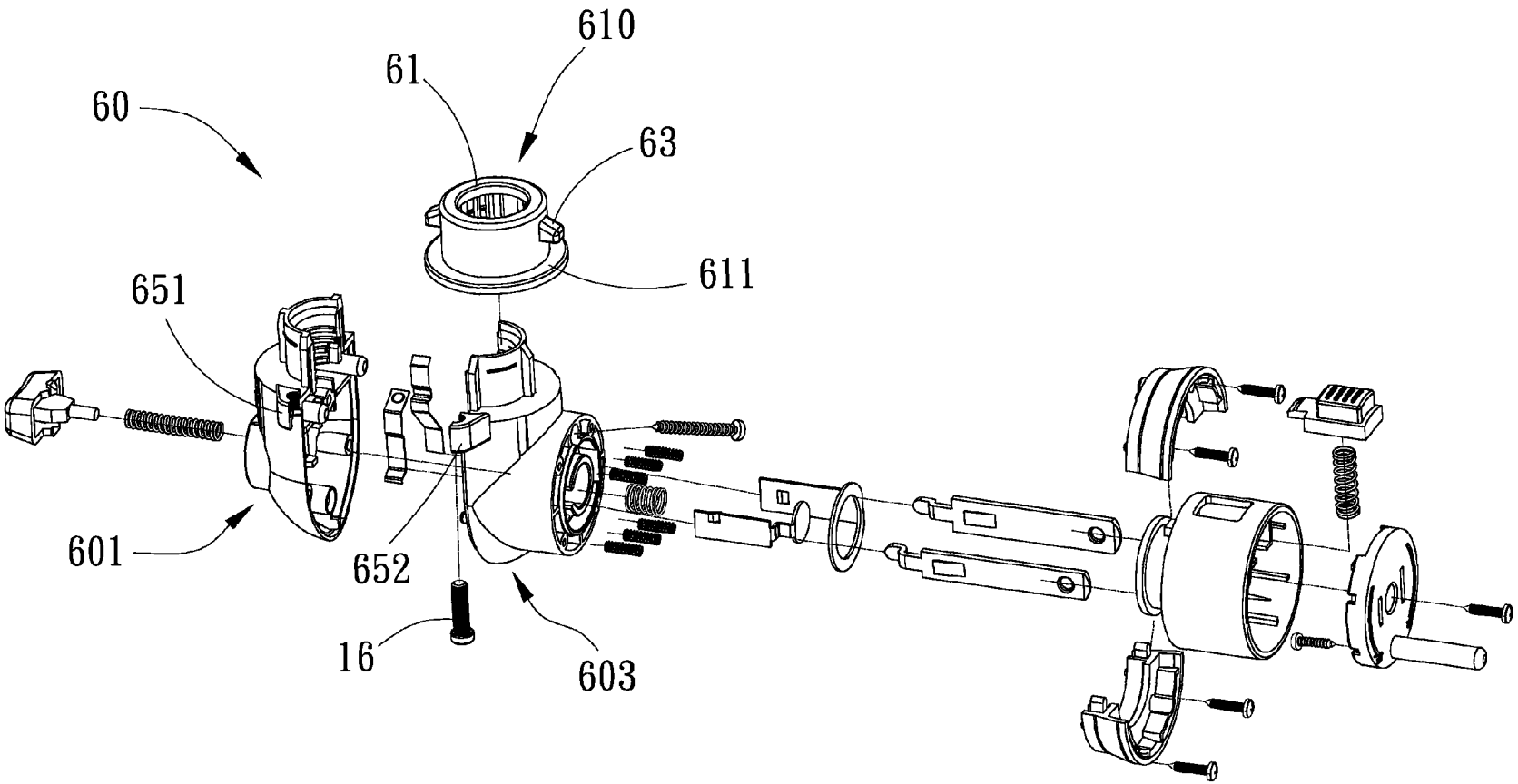
FIG. 4 is an exploded view of a safety lamp bulb connector assembly in accordance with a second embodiment of the present invention.

FIG. 4 illustrates a safety lamp bulb connector assembly in accordance with a second embodiment of the present invention. According to this alternate form, the electric connector assembly 60 further comprises symmetric first shell 601 and second shell 603 and a socket 610. The symmetric first shell 601 and second shell 603 are abutted against each other and then fixedly fastened together. The aforesaid retaining blocks 63 are located on the periphery of the socket 610. The bottom flange 611 of the aforesaid lamp socket 61 is located on the bottom side of the socket 610. The bottom flange 611 of socket 610 is set in between the symmetric first shell 601 and second shell 603 and firmly secured thereto after fixation of the symmetric first shell 601 and second shell 603.

Further, the first shell 601 comprises a threaded arched block 651. The second shell 602 comprises a threaded arched block 653 matching the threaded arched block 651 of the first shell 601. When the first shell 601 and second shell 603 are fastened together, the threaded arched blocks 651; 653 form the aforesaid screw holder 65 for the mounting of the screw 16 to prohibit rotation of the lampshade 20 relative to the socket 610.

Figure 5:
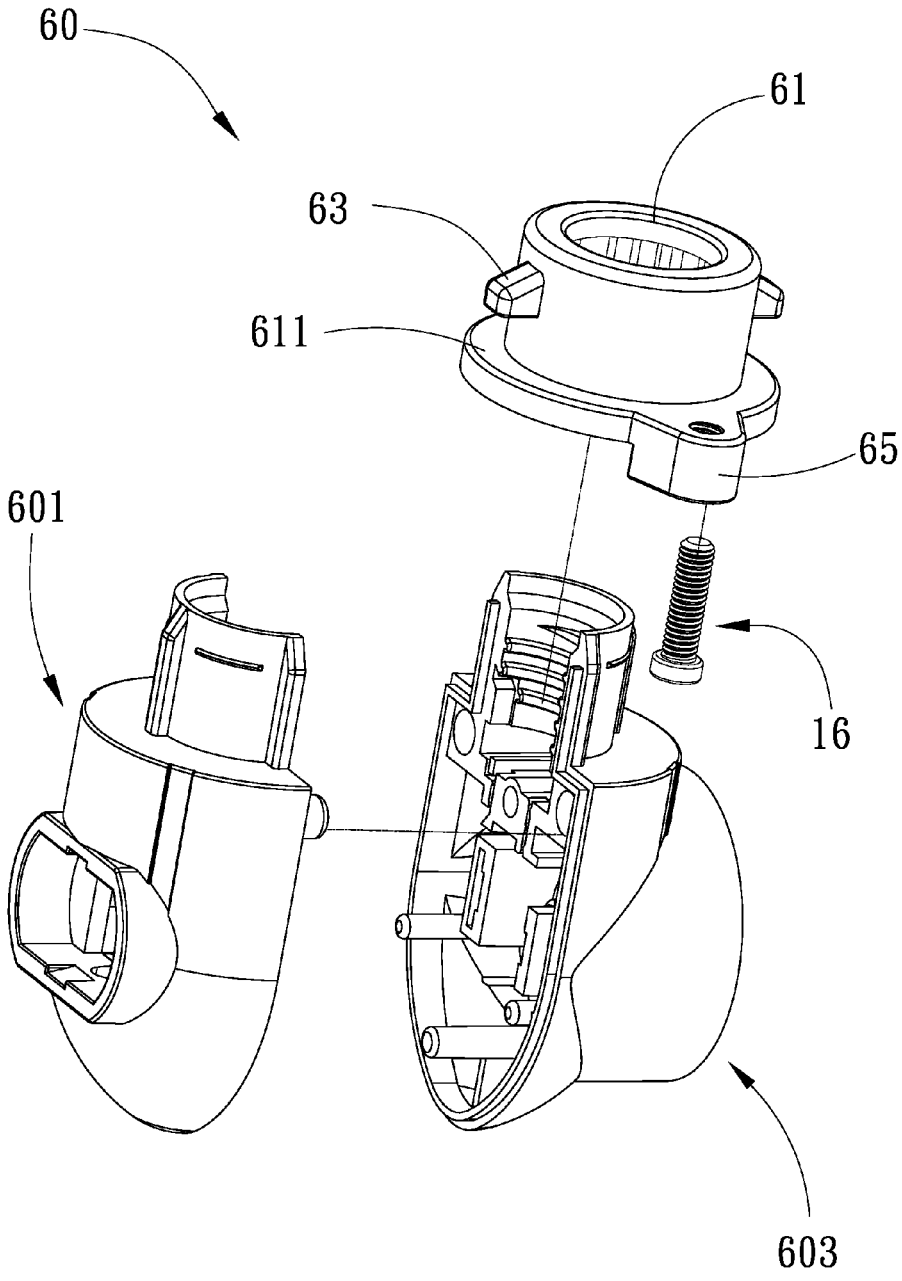
FIG. 5 is an exploded view of a safety lamp bulb connector assembly in accordance with a third embodiment of the present invention.

FIG. 5 illustrates a safety lamp bulb connector assembly in accordance with a third embodiment of the present invention. According to this embodiment, the screw holder 65 is located on the periphery of the bottom flange 611 of the lamp socket 61 for the mounting of the screw 16. This embodiment achieves the same effects as the aforesaid first embodiment.

Referring to FIG. 3 again, a rubber ring 70 can be set in between the bottom wall 22 of the lampshade 20 and the bottom flange 611 of the lamp socket 61 to enhance the connection stability between the lampshade 20 and the lamp socket 61. The rubber ring 70 is sleeved onto the lamp socket 61 between the retaining blocks 53 and the bottom flange 611. After connection between the lampshade 20 and the lamp socket 61, the rubber ring 70 is squeezed between the bottom wall 22 of the lampshade 20 and the bottom flange 611 of the lamp socket 61.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A safety lamp bulb connector assembly, comprising:

an electric connector assembly comprising a lamp socket disposed at a top side thereof, said lamp socket comprising a bottom flange extending around the periphery of a bottom side thereof, at least one retaining block located on the periphery of said lamp socket and spaced above said bottom flange, and a screw holder disposed adjacent to said bottom flange of said lamp socket;

a lampshade mountable on said lamp socket, said lampshade comprising a bottom wall, a center opening cut through said bottom wall for receiving said lamp socket, and at least one notch cut through said bottom wall and radially outwardly extended from said center opening for the passing of said at least one retaining block, said center opening having a diameter greater than the diameter of the periphery of said lamp socket and smaller than the diameter of said bottom flange of said lamp socket; and a screw mounted in said screw holder and inserted into one said notch of said lampshell to prohibit rotation of said lampshade relative to said lamp socket.

2. The safety lamp bulb connector assembly as claimed in claim 1, wherein said lampshade comprises two notches cut through said bottom wall and radially outwardly extended from said center opening in reversed directions; said electric connector assembly comprises two retaining blocks located on the periphery of said lamp socket at two opposite sides corresponding to said two notches.

3. The safety lamp bulb connector assembly as claimed in claim 2, wherein said two notches have different sizes.

4. The safety lamp bulb connector assembly as claimed in claim 3, wherein said electric connector assembly further comprises symmetric first shell and second shell fastened together to hold said bottom flange of said lamp socket therein and to keep said at least one retaining block on the outside of said first shell and said second shell.

5. The safety lamp bulb connector assembly as claimed in claim 4, wherein said first shell and said second shell each comprise a threaded arched block, the threaded arched block of said first shell being abutted against the threaded arched block of said second shell to form said screw holder.

6. The safety lamp bulb connector assembly as claimed in claim 4, wherein said screw holder is located on the periphery of said bottom flange of said lamp socket.

7. The safety lamp bulb connector assembly as claimed in claim 1, further comprising a rubber ring sleeved onto said lamp socket between said bottom flange and said at least one retaining block.

8. The safety lamp bulb connector assembly as claimed in claim 1, wherein said lamp socket holds an electric lamp bulb.

9. The safety lamp bulb connector assembly as claimed in claim 1, which is made in the form of a night lamp.

* * * * *